US011653765B2

(12) United States Patent
Johnson

(10) Patent No.: US 11,653,765 B2
(45) Date of Patent: May 23, 2023

(54) UTILITY CADDY FOR A SEAT

(71) Applicant: Keith Norman Johnson, Conway, SC (US)

(72) Inventor: Keith Norman Johnson, Conway, SC (US)

( * ) Notice: Subject to any disclaimer, the term of this patent is extended or adjusted under 35 U.S.C. 154(b) by 0 days.

(21) Appl. No.: 17/482,246

(22) Filed: Sep. 22, 2021

(65) Prior Publication Data

US 2022/0087432 A1 Mar. 24, 2022

Related U.S. Application Data

(60) Provisional application No. 63/081,984, filed on Sep. 23, 2020.

(51) Int. Cl.
*A47C 7/62* (2006.01)

(52) U.S. Cl.
CPC ..... *A47C 7/626* (2018.08)

(58) Field of Classification Search
CPC ..... A47C 7/622; A47C 7/624; A01K 97/22
USPC ..... 297/188.2
See application file for complete search history.

(56) References Cited

U.S. PATENT DOCUMENTS

| | | | | |
|---|---|---|---|---|
| 4,645,167 | A * | 2/1987 | Hardwick | B63B 29/04 248/283.1 |
| 4,852,499 | A * | 8/1989 | Ozols | A47B 23/04 108/166 |
| 4,997,209 | A * | 3/1991 | McGrath | A47L 9/242 285/332 |
| 9,249,954 | B2 | 2/2016 | Johnson | |
| 11,149,904 | B1 * | 10/2021 | McGuffin | A01K 97/08 |
| 2015/0289494 | A1 * | 10/2015 | Davis | A47C 7/62 43/55 |
| 2020/0015468 | A1 * | 1/2020 | Jelinek | F16B 2/065 |

* cited by examiner

*Primary Examiner* — Sarah B McPartlin
(74) *Attorney, Agent, or Firm* — Moore & Van Allen PLLC; W. Kevin Ransom

(57) ABSTRACT

The invention is directed to a seat caddy. The caddy connects to a support shaft below a seat and has a laterally extending arm. Connected to the laterally extending arm are various trays, connectors, and the like for connecting various utility devices to the laterally extending arm, such as cup holder, phone holder, quick connects for receipt of an umbrella, fishing net, or other extending rods, bucket holder, or other items. In some embodiments, the seat caddy is rotatably connected to the base of the seat, such that the caddy may be rotated about an axis of the support for positioning in different locations relative to the seat.

14 Claims, 12 Drawing Sheets

UTILITY CADDY FOR A SEAT

CROSS-REFERENCE TO RELATED APPLICATION

This application is a non-provisional of and claims priority to U.S. Provisional Application No. 63/081,984 filed on Sep. 23, 2020, of the same title; the contents of which are also incorporated herein by reference.

FIELD OF THE INVENTION

Disclosed is a utility caddy for a seat. The caddy is connected to a base of the seat and is configured to hold or retain various utility devices for a user of the seat.

BACKGROUND OF THE INVENTION

Convenience to tools and other implements is important when a user is seated. The issue is determining positioning of such tools and implements so as to be convenient to the user, but also not obstructive to the activity of the user when seated. This issue is found in various environments, including workspaces, homes, sports, hunting, fishing, to name a few.

As an example, consider a seat in a fishing boat. In this environment, the boat seat is typically rotatable so that the user can rotate within a range of angles or even up to 360 degrees to perform the various actions associated with fishing. The issue is that the actions of fishing require various implements, such as fishing poles, bait containers, catch nets, pliers, and the like, which are important to keep within arms-reach. Further, while implements are needed at various times during fishing, such as catch nets, such implements should not be placed in such a way to impede other fishing actions when the catch net is not is in use, such as when the user is casting. This issue is exacerbated when the user can rotate the seat.

Another example may be in a hunting blind, where the user needs access to a rifle or bow and arrows, binoculars, animal calls, ammunition, and the like. Here again, the user needs quicks access to these various implements, but also needs the implements in such a position to not obstruct the hunter when not in use.

Similar scenarios can be envisioned in various other environments, such as workspaces, manufacturing facilities, etc.

SUMMARY OF THE INVENTION

The disclosed invention is directed to a seat caddy. It connects to the central support shaft below a seat and has a laterally extending arm. Connected to the laterally extending arm are various trays, connectors, and the like for connecting various utility devices to the laterally extending arm, such as cup holder, phone holder, quick connects for receipt of an umbrella, fishing net, or other extending rods, bucket holder, or other items.

In some embodiments, the seat caddy is rotatably connected to the base of the seat, such that the caddy may be rotated about an axis of the support for positioning in different locations relative to the seat.

As an example, in one embodiment, the invention is directed to a caddy for a seat where the seat is connected to a base by a shaft. The caddy comprises an arm extending along a length between proximal and distal ends; and a coupling device adjacent to the proximal end of the arm, wherein the coupling device is configured to mate with the shaft of the base to which the seat is connected. In various embodiments, the first end of the coupling device is connected to the proximal end of the arm.

In one embodiment, the coupling device comprises a body extending between first and second ends and comprising a bore extending therethrough. In some embodiments, the bore of the coupling device has an inner dimension sized to receive the shaft of the base. As an example, in some embodiments, the inner dimension of the bore of the coupling device is a diameter in the range of 1 to 3 inches, and in one embodiment is one and three-quarter (1.75) inches, while it is understood that the diameter could be any sized as is required to connect with the shaft of the seat.

In one embodiment, the bore of the coupling device is sized to receive a second shaft extending from a bottom surface of the seat, to couple the seat to the shaft of the base. In other words, the coupling device is sized to fit the shaft of the base and also sized to fit a shaft extending from the seat to connect the seat to the base.

In some embodiments, the coupling device is rotatably connected to the shaft of the base so that the extending arm can be rotated relative to the base and the seat. For example, in one embodiment, the coupling device comprises a body extending between first and second ends and comprising a bore extending therethrough, wherein the bore of the coupling device has an inner dimension diameter sized to receive the shaft of the base of the seat, and wherein the bore of the coupling device is circular and the shaft of the base is circular so that the coupling device is capable of rotating relative to the shaft of the base.

In some embodiments, the caddy may further include an adapter for connecting the coupling device to the shaft of the base. In one embodiment, the bore of the coupling device has an inner dimension, and the adapter comprises a second body having an outer dimension sized to fit within the bore of the coupling device and a second bore therein having a dimension size to fit over the shaft of the base so as to connect the coupling device to the shaft of the base. An adapter may be instead or in addition used to connect the coupling device to the shaft of the seat and would have a similar configuration.

In some embodiments, the caddy may further comprise a platform adjacent a distal end of the arm for accommodating implements. In one embodiment, the platform has a vertical extending side and a substantially horizontal surface connected to the vertical extending side, wherein the vertical extending side is connected to the arm approximate the distal end of the arm. In some embodiments, the platform is connected to a top of the arm and extends above the arm to create a shelf. In other embodiments, the platform could extend below the arm. In some embodiments, the platform includes at least one of a hole in or a connector attached to the platform.

In some embodiments, the arm of the caddy may include various holes, connectors, cup holders, horizontal trays, cell phone holders, bait containers, lights, umbrella connectors and the like for retaining various implements for the user of the seat.

In one embodiment, the caddy for a seat comprises an arm extending along a length between proximal and distal ends; and a coupling device adjacent to the proximal end of the arm, wherein the coupling device is configured to mate with the shaft of the base to which the seat is connected and is rotatable about the shaft.

In one embodiment, the caddy for a seat comprises an arm extending along a length between proximal and distal ends;

and a coupling device adjacent to the proximal end of the arm, wherein the coupling device comprises a body extending between first and second ends and comprising a bore extending therethrough, wherein the bore of the coupling device has an inner dimension diameter sized to receive the shaft of the base of the seat, and wherein the bore of the coupling device is sized to receive a second shaft extending from a bottom surface of the seat, so as to couple the seat to the shaft of the base.

BRIEF DESCRIPTION OF THE DRAWINGS

The present invention relates to a caddy for a seat. It is envisioned to connect to a base for the seat and include various platforms, holes, connectors, and the like for holding or connecting implements to an arm of the caddy so as to accessible by the user of the seat. The advantages and features of the invention, and the manner in which the same are accomplished, will become more readily apparent upon consideration of the following detail description of the invention taken in conjunction with the accompanying drawings, which illustrate preferred and exemplary embodiments, and which are not necessarily drawn to scale, wherein.

DETAILED DESCRIPTION OF THE INVENTION

Figure 1:
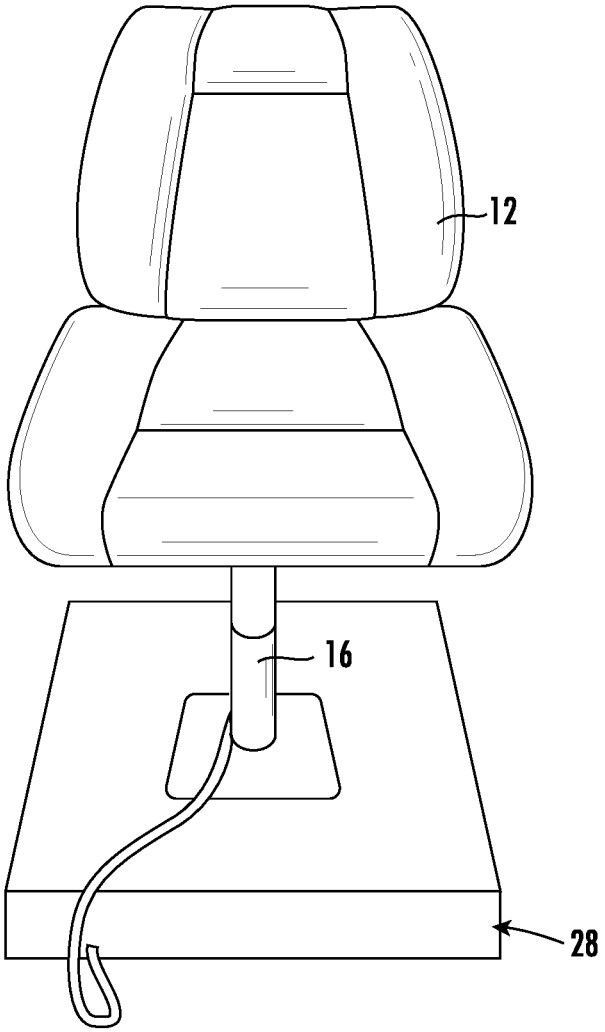
FIG. 1 PRIOR ART
FIG. 1 illustrates a view of a seat connected to a base according to the prior art.

FIG. 1 illustrates a seat 12, such as a boat seat, as known in the prior art. The seat 12 is connected to a base 28 by a shaft 16. In some embodiments, the seat includes a shaft having an outer dimension that is smaller than a bore in the end of the shaft 16 of the base, so that the shaft of the seat fits into the bore of the shaft 16 to thereby connect the seat 12 to the base 28. It is noted here that the seat depicted in the figures is for illustrative purposes and should not limit the invention. It is envisioned that the caddy of the present invention can be used with any seat that is connected to one or more shafts. For example, the caddy could be used with a chair having more than one leg (shafts) by connecting the caddy to one of the legs. Further, as discussed further below, the seat used with the caddy of the invention does not require that the shaft of the seat be in two pieces, as for some examples, the coupling device may be a clamp that attaches to the outer periphery of the shaft.

Figure 2:
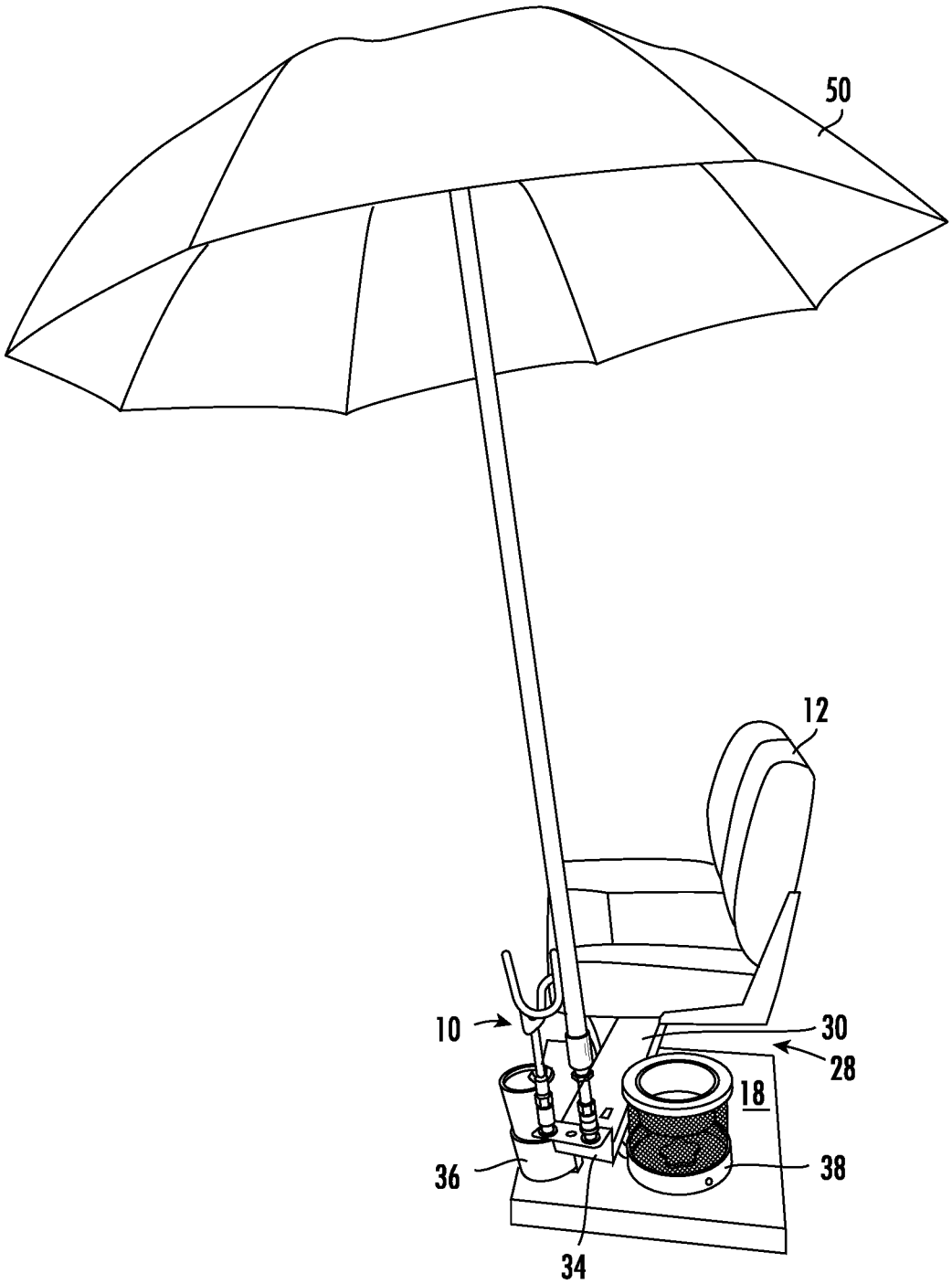
FIG. 2 illustrates a view of a caddy according to an embodiment of the invention with connection of various implements.

With reference to FIG. 2, provided is a utility caddy 10 for a seat 12. In the illustrated embodiment, the caddy 10 includes an arm 32 connected by a coupler (not shown) to the shaft 16 of the base 28. As illustrated, various structures may be connected to the arm 32 for retaining various utility devices for a user. For example, in one embodiment, the caddy 10 comprises at least one cup holder 36 connected to a side of the arm 30 adjacent a distal end of the arm 30 for retaining a cup, mug or glass. In some embodiments, the caddy may include a horizontal tray 38 connected to a side of the arm 30 for retaining various items on its upper surface, such as, for example, a bait bucket 40 for fishing, or ammo for hunting, or any other item the user wishes to stow on the horizontal surface of the tray 38.

Figure 3:
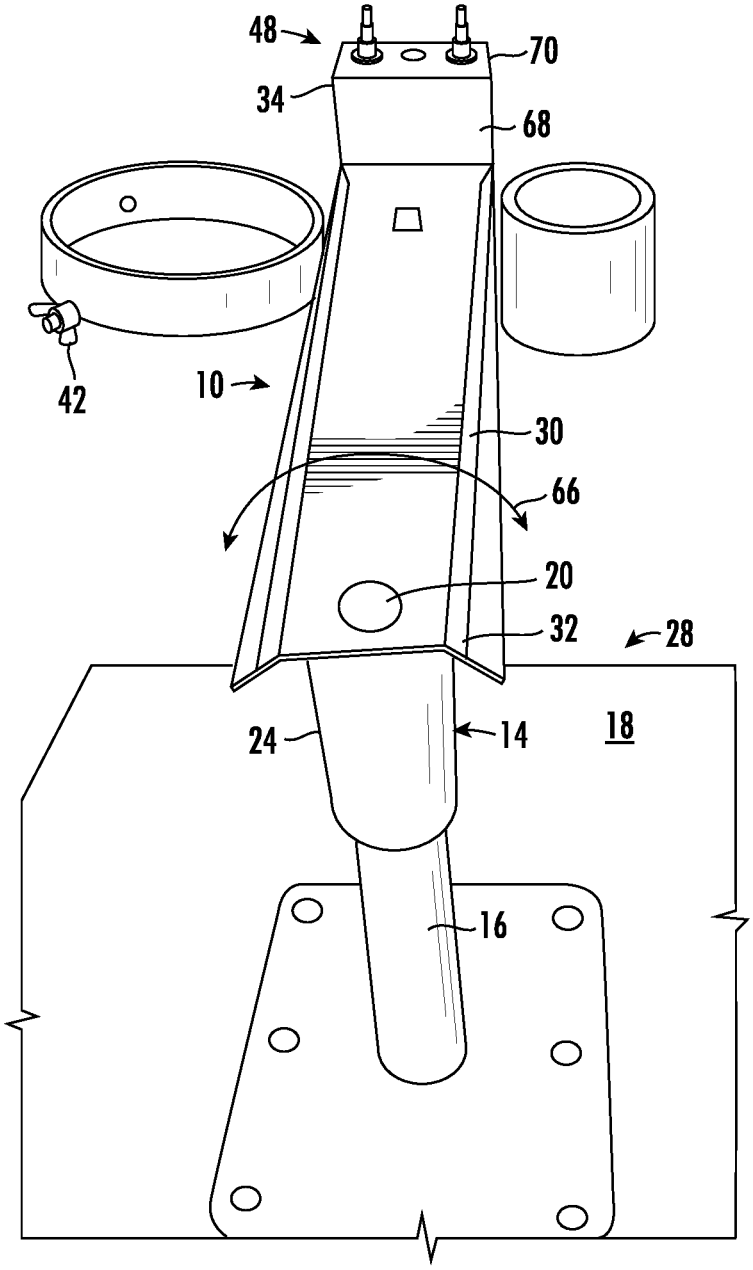
FIG. 3 is a perspective view of a caddy according to one embodiment of the present invention.
Figure 4:
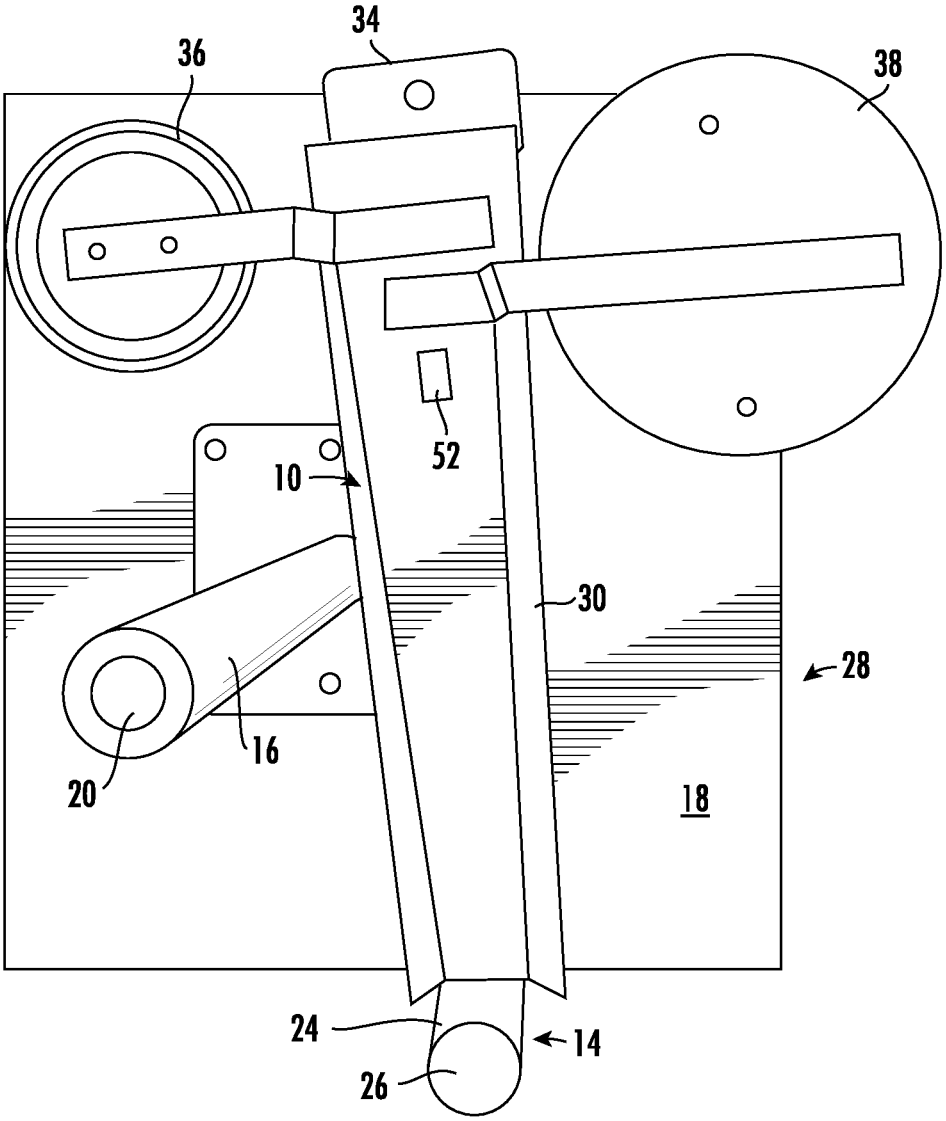
FIG. 4 is a top view of a caddy according to one embodiment of the present invention.

With reference to FIG. 3, the utility caddy 10, according to one embodiment of the present invention, includes an arm 32 having a body extending between a proximal end 32 and a distal end 34. Connected to the proximal end is a coupling device 14. As is illustrated in FIG. 4, in one embodiment, the coupling device 14 of the caddy 10 comprises a cylindrical body 24 with a central bore 26. The central bore is configured to fit over the end of the shaft 16 of the base 28 of the seat.

As is understood, the central bore 26 of the coupling device will be sized relative to the dimensions of the shaft 16 of the base 28, so as to allow the shaft 16 to be inserted in the central bore 26. In general, the diameter of the central bore is in the range of 1 to 3 inches, and in one embodiment is one and three-quarter (1.75) inches.

As is understood, instead of the configuration shown where the cylindrical body 24 has a central bore 26 in which the shaft 16 is inserted, the cylindrical body, instead could have a dimension such that it may be inserted into the bore 20 of the shaft 16 instead as a means of connection.

Regarding the length of the arm 32, it is understood that it can be of any length as may be required to extend passed a perimeter of the seat and be accessible to the user. In the illustrated embodiments, the arm has a length of approximately twenty (20) inches between its proximal and distal ends. Further, it may be of any shape, such as flat, round, square, rectangular, etc.

Referring again to FIG. 5, once the coupling device 14 is connected to the shaft 16 of the base, the seat may then be connected to the shaft 16 of the base 28. For example, as shown in FIG. 4, in one embodiment, the central bore 26 of the coupling device is open and exposing a bore 20 in the end of the shaft 16 of the base, where the bore 20 is configured to receive a connecting shaft protruding from a bottom of the seat 12. In this manner, for this embodiment, the coupling device 14 is connected to the end of the shaft 16 of the base and the seat is connected to the shaft 16. In general, the seat 12 includes a connecting shaft that fits into a bore 20 in the end of the shaft 16 of the base.

Figure 5:
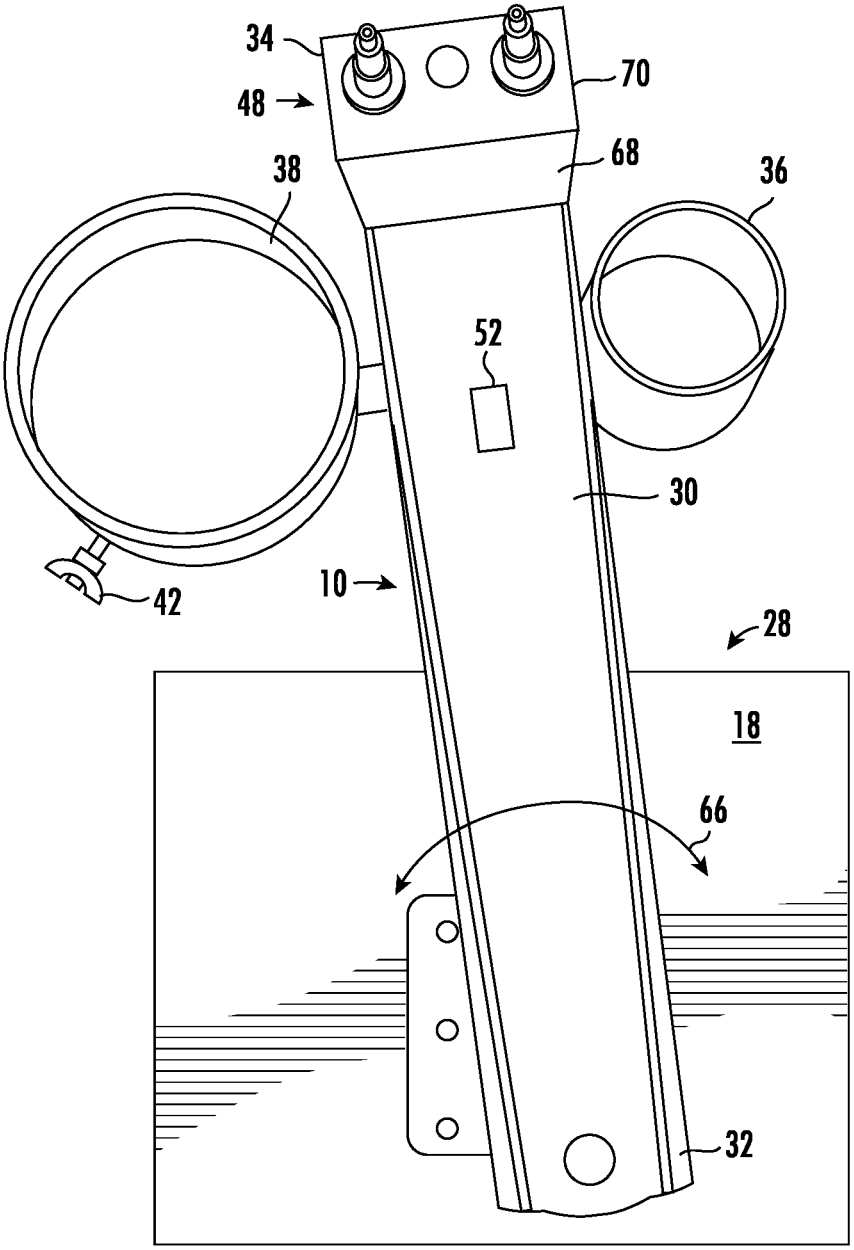
FIG. 5 is a bottom view of a caddy according to one embodiment of the present invention.

As illustrated in FIG. 5, the coupling device 14 is fitted to the shaft 16. In some embodiments, this configuration may allow the arm 32 to be rotated relative to the base 28 and the seat 12. This allows the caddy to be placed in various orientations relative to the seat via rotation 66, as shown in FIG. 5. For example, the caddy could be rotated to a left side of seat or the right side of the seat as desired by the user. Further, in some embodiments, the arm can be rotated to a position behind the seat to be out of the way when not in use, such as when the user is driving a boat while in the seat.

Figure 6A:
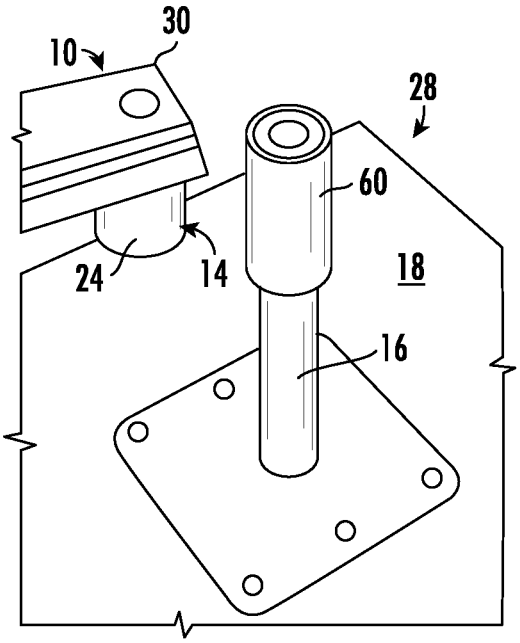
FIGS. 6A-6C illustrate an embodiment of an adapter for use in connecting a caddy according to one embodiment of the invention with a shaft of a base.
Figure 6B:
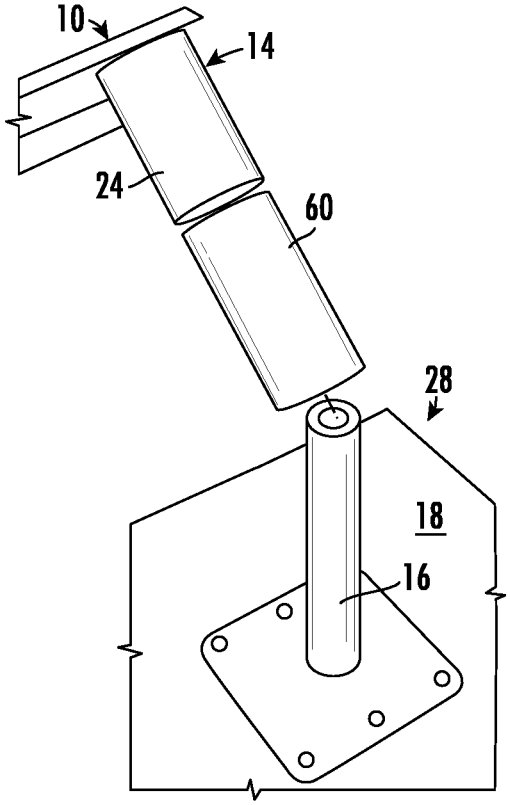
Figure 6C:
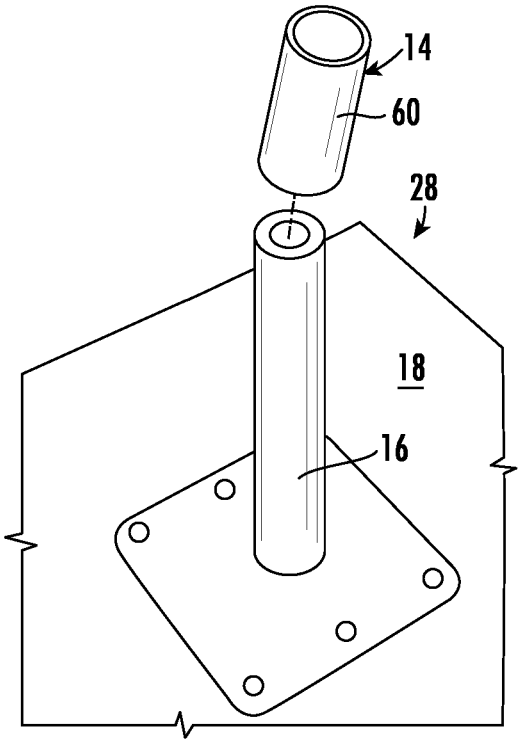

With reference to FIGS. 6A-6C, in some embodiments, the caddy may include an adapter 60 for insertion into the bore of coupling device 14 so as to size the coupling device to different diameter shafts 16 of a given base. In one embodiment, the central bore 26 of the coupling device 14 has an inner dimension and the adapter 60 comprises a second body having an outer dimension sized to fit within the central bore 26 of the coupling device 14 and a second central bore therein having a dimension sized to fit over the shaft 16 of the base 28 so as to connect the coupling device 14 to the shaft 16 of the base. An adapter may be instead or in addition used to connect the coupling device to the shaft of the seat and would have a similar configuration.

In one or more embodiments, as shown in FIGS. 3 and 5, the caddy may further comprise a platform 48 adjacent a distal end 34 of the arm 32 for accommodating implements. In one embodiment, the platform has a vertical extending side 68 and a substantially horizontal surface 70 connected to the vertical extending side, wherein the vertical extending side is connected to the arm 32 approximate the distal end 34 of the arm. In some embodiments, the platform is connected to a top of the arm and extends above the arm to create a shelf above the arm 32, as depicted in the Figs. In other embodiments, the platform 48 could extend below the arm 32 to create a shelf below the arm. While the vertical extending side 68 is depicted as substantially perpendicular to the arm 32, it is understood that in other embodiments, the vertical extending side 68 of the platform 48 may extend at a desired angle relative to the arm 32. Further, the vertical extending side 68 and/or the horizontal surface 70 can be of any desired dimension as desired for height and width.

Connected to the arm 32 may be various structures for retaining various utility devices for a user. For example, in one embodiment, the caddy 10 comprises at least one cup holder 36 connected to a side of the arm 30 adjacent the distal end 34 of the arm 30 for retaining a cup, mug or glass. In some embodiments, the caddy may include a horizontal tray 38 connected to a side of the arm 30 for retaining various items on its upper surface, such as, for example, a bait bucket 40 for fishing, or ammo for hunting, or any other item the user wishes to stow on the horizontal surface of the tray 38.

In some embodiments, as shown in FIGS. 3 and 5, the horizontal tray 38 may include a retainer 42, such as a threaded bolt or a spring-loaded bolt, that can be adjusted to abut against an item located on the horizontal tray 38 to hold the item in place.

Figure 7:
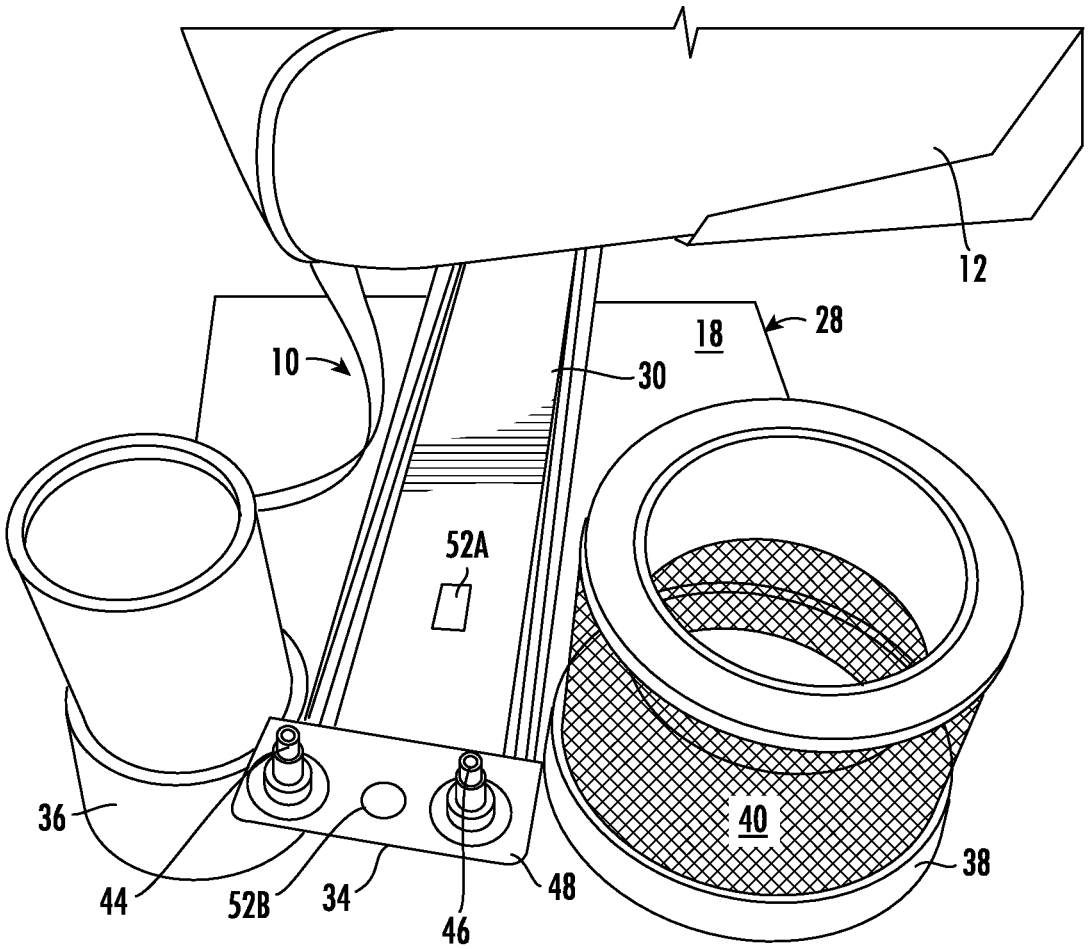
FIG. 7 is a perspective view of a caddy according to one embodiment of the present invention.

In some embodiments, as illustrated in FIG. 7, the distal end 34 of the arm 30 may include one or more quick disconnect connectors 44,46. These may be located on the raised platform 48, as illustrated in FIG. 7, or merely connected to the distal end 34 of the arm 30. The quick disconnect connectors may be used to connect various items to the arm 30. For example, in one embodiment, as shown in FIG. 2, an umbrella 50 may have a quick disconnect connector attached thereto that can be connected to one of the quick disconnect connectors 44,46 located on the arm. As can be envisioned, any number of items, such as an umbrella, a fishing rod holder 62 (see FIG. 8), a catch net, tools or any item can be equipped with a connector for connection to one of the connectors 44,46 of the arm 30. It is understood that while quick disconnect connectors are illustrated, any type of connection system may be employed. For example, in some embodiments the connectors 44,46 could simply be extending rods that insert into a hole portion of a tool, such as shown in some examples (see FIG. 9), where duck calls are inserted over the connectors 44,46.

In one embodiment, the quick disconnectors may be known connectors in the art, such as connectors used with air compressor tools, where a spring-loaded collar can be manipulated to engage and disengage bearing elements from grooves in the corresponding portion of the connector.

In some embodiments, as shown in FIG. 7, one or more holes 52 may be provided in the arm 30 for use in inserting various tools, such as pliers in the illustrated embodiment.

Figure 10:
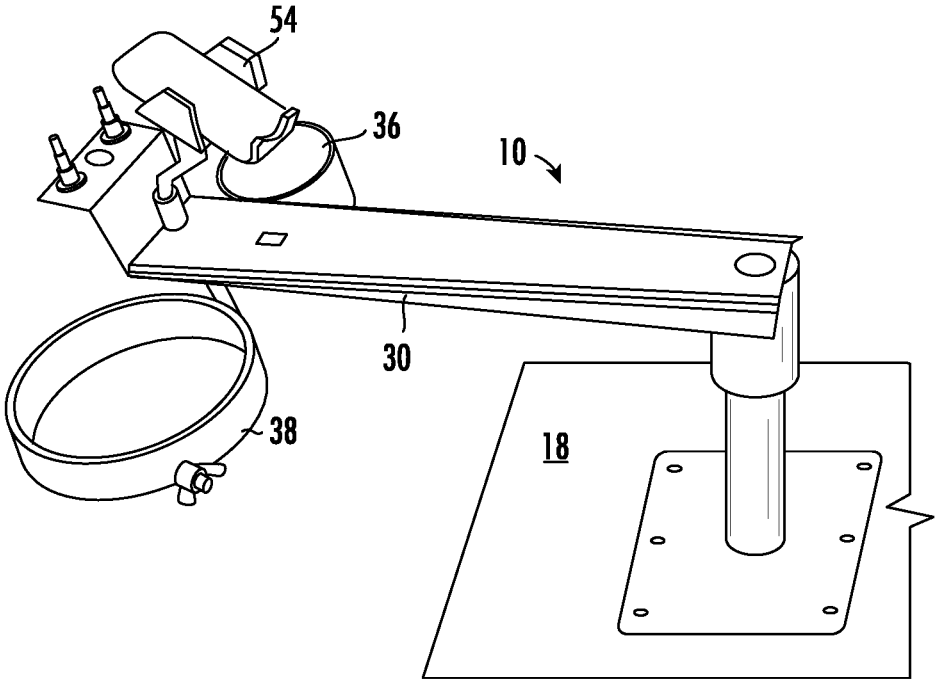
FIG. 10 is a perspective view of a caddy according to one embodiment of the present invention.

In some embodiments, as shown in FIG. 10, a connector 54 for a phone, laptop or other portable device may be provided for retaining a cell phone.

Figure 11:
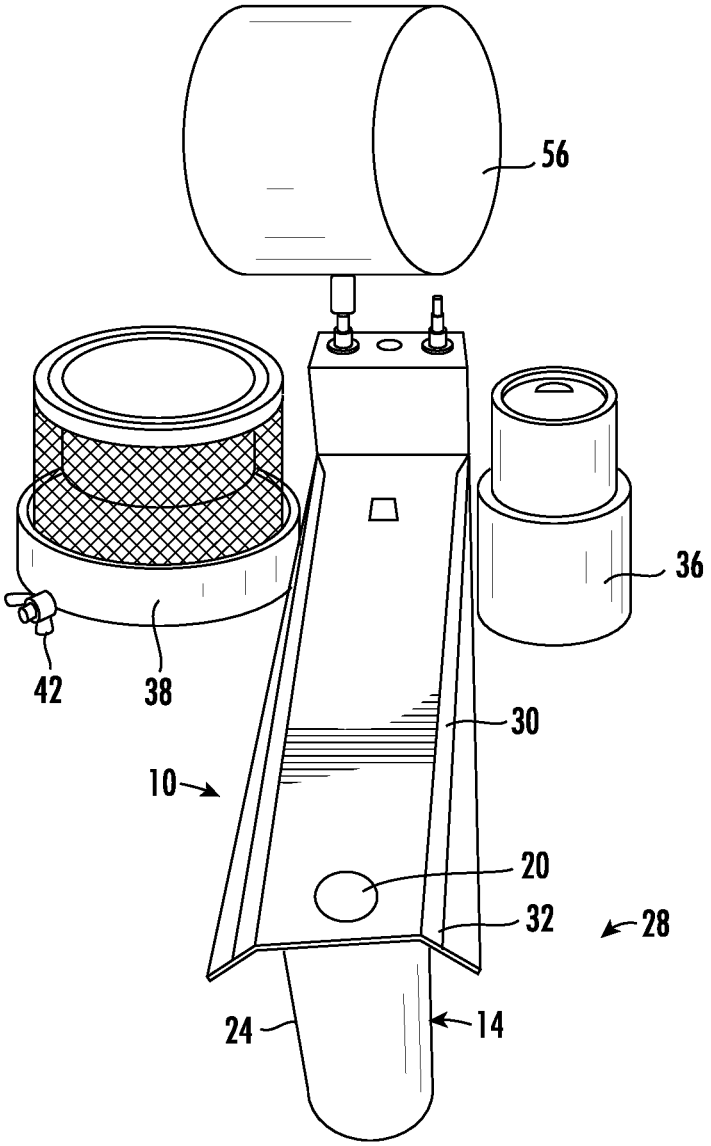
FIG. 11 is a perspective view of a caddy according to one embodiment of the present invention.

In one embodiment, as shown in FIG. 11, a lamp 56 with a glow light for bait may be connected to the arm, such as the glow lamp disclosed in U.S. Pat. No. 9,249,954.

It is envisioned that various holes, connectors, platforms, holders, hooks, and the like may be connected to the arm 30 as desired to retain various tools and items that the user desires to have access to while seated.

Figure 8:
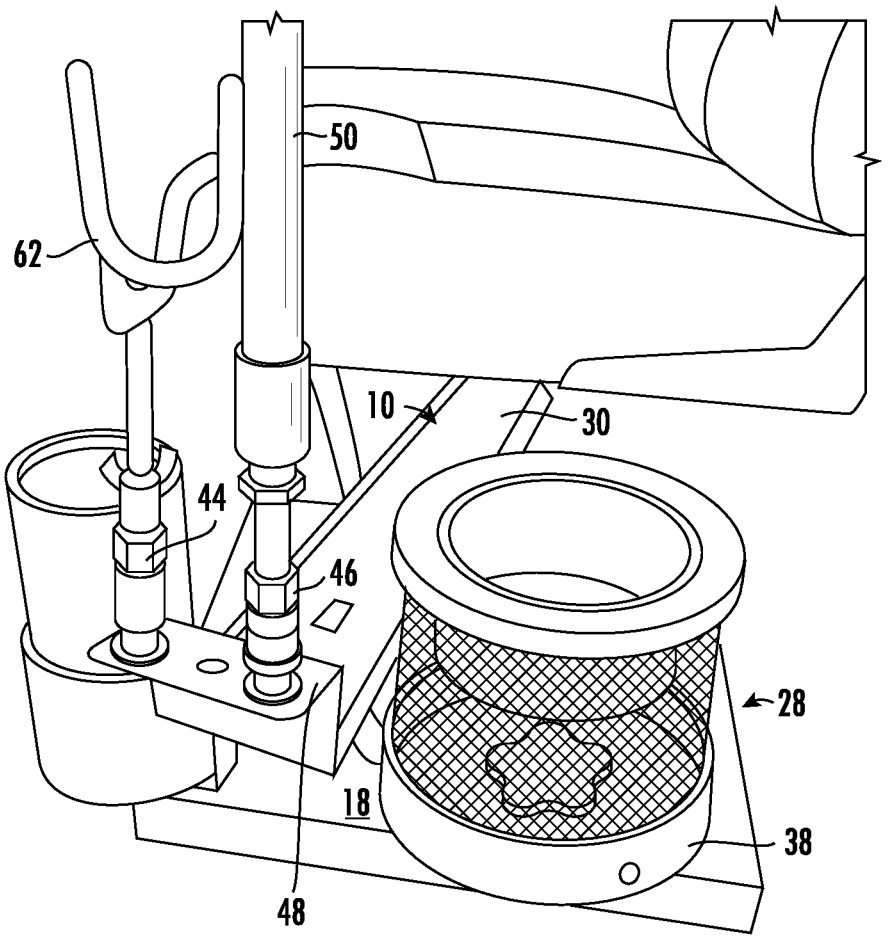
FIG. 8 is a perspective view of a caddy according to one embodiment of the present invention.
Figure 9:
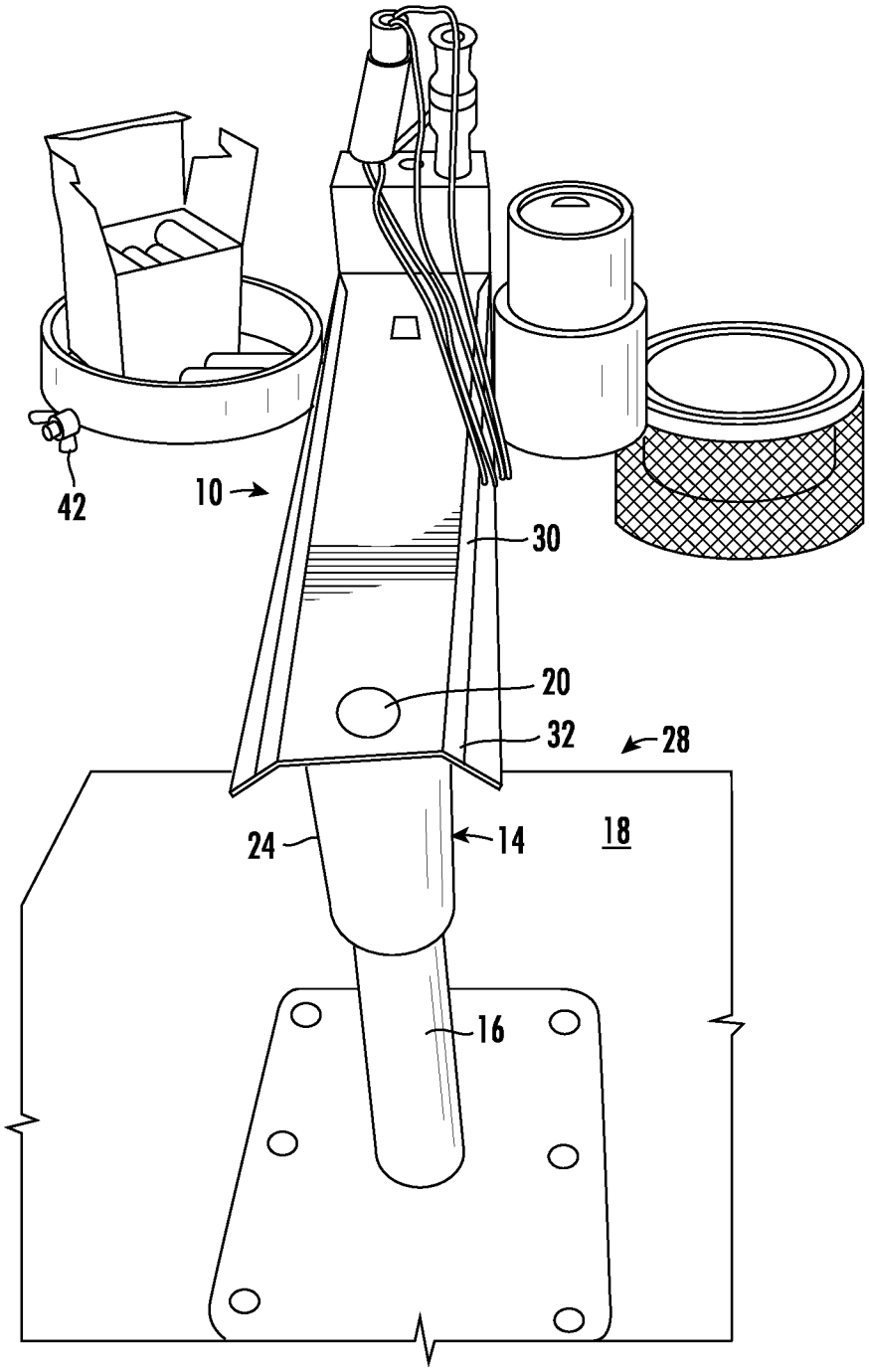
FIG. 9 is a perspective view of a caddy according to one embodiment of the present invention.

FIGS. 6 and 8 disclose a coupling device in the form of an element having an inner bore for fitting over the shaft 16 of the base 28 to thereby connect the caddy to the base and allow the caddy to rotate thereabout. It is understood that the coupling device can take many forms for connecting to the shaft 16 of the base 28. For example, as mentioned previously, the coupling device, in one embodiment, may be cylindrical in shape and fit inside a bore in the end of the shaft 16 of the base 28.

Figure 12:
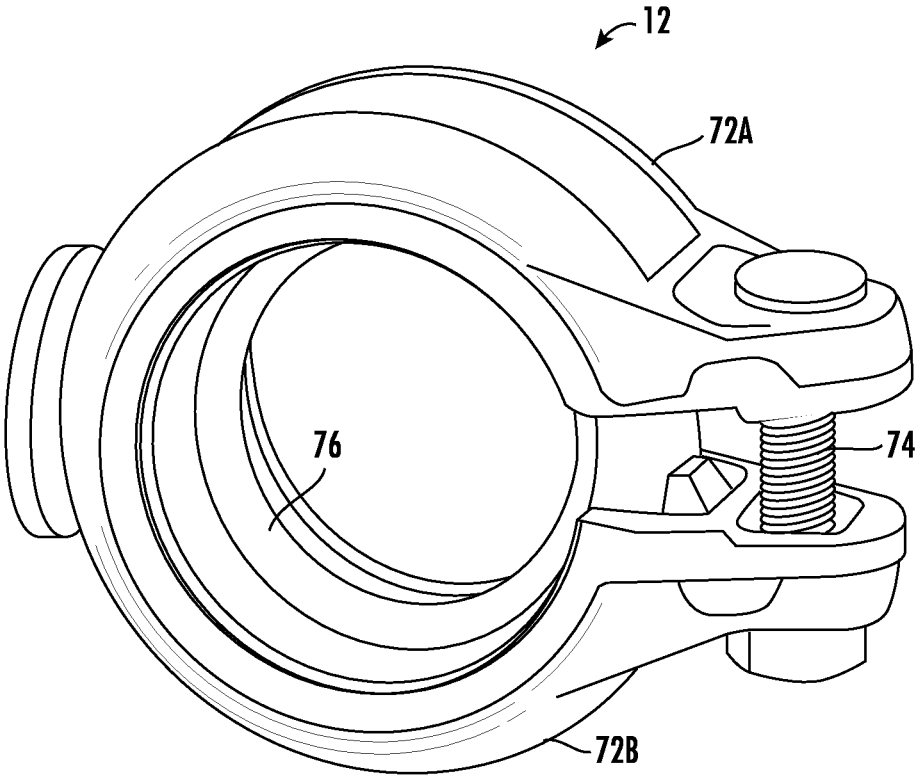
FIG. 12 is a perspective view of a coupling device according to one embodiment of the present invention.

In one embodiment, the coupling device 14 could be a pressure biased clamp, such as shown in FIG. 12. In this embodiment, the coupling device 14 includes two opposing sides 72A, 72B that are hinged or otherwise connected on one side. The other ends of the opposing side are connected to a threaded rod 74 that varies the distance between the opposing sides, such that the coupling device may be clamped around a periphery of the shaft 16 of the base. In some embodiment, the clamp may include a smooth or lubricated inner collar or ring(s) 76, such as collar made of silicon, which once the clamp is in place, the inner collar will allow the caddy to rotate about the shaft. In another embodiment, bearings may be located on the inner surfaces of the opposing sides, to thereby allow the clamp to rotate about the shaft, once connected. While not shown, the threaded rod could have a knob or wing nut for use in tightening and loosening the clamp.

As is understood from the discussion above and the drawings, the invention is directed to a caddy that can be connected to a seat. The caddy comprises and arm with a coupling device on a proximal end. The coupling device is connected to a seat at a shaft, post or leg below the seat. In some embodiments, the coupling device fits over the shaft or post or could be pressure coupled to the shaft. In some embodiments, the coupling device allows for rotation of the arm of the caddy about the shaft. The arm extends past the periphery edge of the seat and may have various connectors, holders, platforms, etc. for retaining various implements that can be accessed by a user while seated.

The invention claimed is:

1. A caddy for a seat where the seat is connected to a base by a shaft extending from the seat inserted into a bore in a shaft of the base, said caddy comprising;

an arm extending along a length between proximal and distal ends; and a coupling device adjacent to the proximal end of the arm, wherein said coupling device is configured to mate with the shaft of the base to which the seat is connected, wherein the coupling device comprises:

a body extending between a top and a bottom;

a first bore extending from the bottom through the body toward the top, wherein said first bore is circular in shape and has an inner dimension sized to receive the shaft of the base; and a second bore extending from the top of the coupling device to the first bore, wherein the second bore is circular and sized to receive the shaft of the seat so that the coupling device is capable of rotating relative to both the seat and the base and at least a portion of the shaft of the seat is inserted to the shaft of the base.

2. A caddy according to claim 1, the inner dimension of the first bore of the coupling device is a diameter of approximately one and three-quarter (1.75) inches.

3. A caddy according to claim 1, wherein the top of the coupling device is connected to the proximal end of the arm.

4. A caddy according to claim 1 further comprising an adapter for connecting the coupling device to the shaft of the base.

5. A caddy according to claim 1, wherein said bore of the coupling device has an inner dimension, wherein said caddy further comprises an adapter comprising a second body having an outer dimension sized to fit within the first bore of the coupling device and a third bore therein having a dimension sized to fit over the shaft of the base.

6. A caddy according to claim 1 further comprising a platform adjacent a distal end of the arm.

7. A caddy according to claim 6, wherein the platform has a vertical extending side and a substantially horizontal surface connected to said vertical extending side, wherein the vertical extending side is connected to the arm approximate the distal end of the arm.

8. A caddy according to claim 6, wherein the platform includes at least one of a hole in or a connector attached to the platform.

9. A caddy according to claim 1 further comprising one or more connectors connected to the arm adjacent to the distal end of the arm.

10. A caddy according to claim 9, wherein at least one of the connectors is a quick disconnect connector.

11. A caddy according to claim 1 further comprising one or more cup holders connected to the arm adjacent to the distal end of the arm.

12. A caddy according to claim 1 further comprising one or more horizontal trays connected to the arm adjacent to the distal end of the arm.

13. A caddy according to claim 1, wherein the first and second bores have the same inner dimension.

14. A caddy according to claim 1, wherein the first and second bores have different inner dimensions.

* * * * *